United States Patent [19]

Marshall

[11] 4,416,137

[45] Nov. 22, 1983

[54] ROLL CONSTRUCTION

[75] Inventor: Robert Marshall, North Anston, England

[73] Assignee: Davy-Loewy Limited, Sheffield, England

[21] Appl. No.: 326,537

[22] Filed: Dec. 2, 1981

[30] Foreign Application Priority Data

Mar. 20, 1981 [GB] United Kingdom ..... 8108859

[51] Int. Cl.[3] ..... B21B 31/32

[52] U.S. Cl. ..... 72/243; 29/113 R

[58] Field of Search ..... 29/113, 116; 72/241, 72/243, 247

[56] References Cited

U.S. PATENT DOCUMENTS 3,703,862 11/1972 Appenzfeller ..... 29/113 AD X 3,997,953 12/1976 Christ et al. ..... 29/116 AD

FOREIGN PATENT DOCUMENTS 55-133805 10/1980 Japan ..... 72/247

*Primary Examiner*—Eugene F. Desmond

*Attorney, Agent, or Firm*—Lee, Smith & Jager

[57] ABSTRACT

A composite roll for a rolling mill is constituted by a sleeve and an axially adjustable arbor therewithin. The ends of the sleeve are closed by end members, one of which has an axial passage with a diameter smaller than the bore diameter of the sleeve. An adjustment rod is secured to the arbor and passes through the passage of the end member. By operation of the adjustment rod, the position of the arbor within the sleeve and hence the axial compliance of the roll can be adjusted.

4 Claims, 1 Drawing Figure

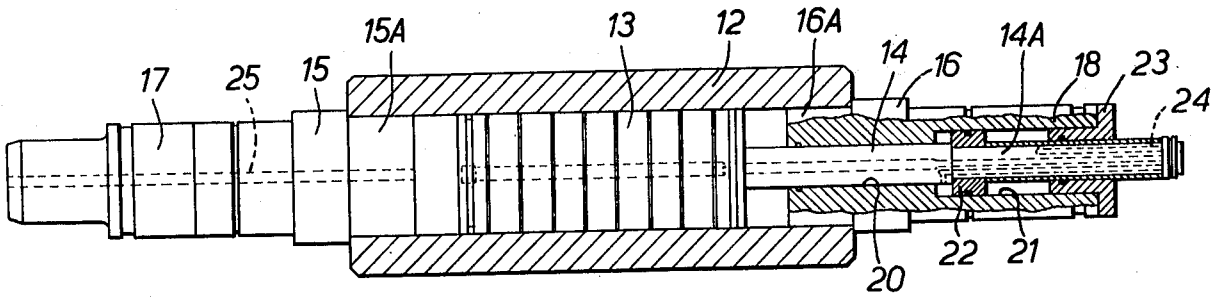
24
23
18
14A
16
14
16A
12
13
15A
15
25
17
21
22
20

ROLL CONSTRUCTION

This invention relates to the construction of a rolling mill roll having adjustable axial compliance. Rolls having that characteristic have been described in U.S. patent application Ser. No. 282,717 of R. W. Gronbech and R. Marshall, filed July 13, 1981; in that application the rolls are illustrated as having central bores in which are located axially adjustable arbors. The rolls consequently have a higher compliance where they are unsupported by the arbors relative to those axial lengths where they are stiffened by the arbors.

Problems arise if a conventional solid roll is bored out to form a hollow roll. The greatest problem arises from the dichotomy between the need to have the bore sufficiently large for adequate roll compliance, and the need for the roll necks, through at least one of which the bore must extend to allow entry and adjustment of the arbor, to be sufficiently strong to transmit the rolling load and to withstand the drive torque, when the roll is driven; for the former, the bore needs a large diameter, while for the latter the bore needs to be of small diameter.

Secondly, for practical use in a rolling mill, the roll should have a life comparable with the life of a conventional solid roll. However, the possible turn-down of a hollow roll is clearly limited relative to that of a solid roll and furthermore a given turn-down of a hollow roll gives a larger change in roll compliance than in the case of a solid roll.

Thirdly, there is the problem of boring out the roll which, because of its intended duty, is made of hard, wear-resisting steel; attempts to bore out such a roll may result in catastrophic fracture of the roll.

In order to avoid those difficulties, it is proposed in this invention to form a hollow roll by employing a preformed sleeve and by securing in each end of the sleeve an end member incorporating a roll neck. Before the end members are secured in place, an arbor is adjustably located within the sleeve, the position of the arbor being adjustable by means such as a rod passing through one of the end members and its roll neck.

As it is no longer necessary to introduce the arbor through a roll neck, it is then possible to have a roll barrel (the sleeve) with an arbor-receiving bore significantly greater in diameter than the bore in the end member provided for the adjustable rod.

Thus, in accordance with one aspect of the present invention, a rolling mill roll having adjustable axial compliance comprises a sleeve forming the barrel of the roll; end members secured in the ends of the sleeve and integral with roll necks; an arbor located within the sleeve and axially movable therein; and adjustment means for the arbor passing axially through a passage in one end member, the diameter of the passage in the end member being significantly less than the internal diameter of the sleeve.

The invention not only removes the conflict between the desired compliance of the barrel and the need for strength in the roll necks, but obviates the necessity of boring out a hardened solid roll; the sleeve can be cast in hard, wear-resisting metal, or it can be formed by boring out a cylinder and subsequently hardened by heat-treatment.

Further, the life of the roll is no longer determined by the amount of turn-down that is available, since it is relatively cheap and easy to fit a new sleeve to the end members and roll necks when wear occurs. Excessive changes in compliance of the sleeve is thereby avoided.

It is not essential that the arbor should be an interference fit within the sleeve and, indeed, such a fit should be avoided for ease of adjustment. Instead, there should be a clearance between the arbor and the bore of the sleeve when the roll is not in use; under the rolling load, the barrel then deflects on to the arbor and the rolling load is taken in part by the sleeve and in part by the arbor.

The invention is illustrated by the following description of an embodiment thereof, reference being made to the accompanying drawing, which shows the roll in axial section.

As illustrated, the roll comprises a sleeve 12 which constitutes the roll barrel and an arbor 13 received within the bore of the sleeve with a clearance fit and having a length substantially less than that of the sleeve. The arbor 13 is secured to a relatively narrow actuating rod 14 extending beyond the sleeve end.

After the arbor has been positioned within the sleeve, end members 15 and 16 are secured in the sleeve ends, as by Bratt mounting, those members having spigot parts 15A and 16A for that purpose. Each end member is integral with a roll neck 17 or 18 by which the roll is journalled in the mill. The end member 16 with its integral roll neck 18 has a passage 20 to receive the rod 14. The passage 20 is coaxial with the bore of the sleeve 12 and a diameter significantly smaller than that of the sleeve bore. The passage within the roll neck 18 is enlarged at 21 and receives a piston 22, which is secured on a reduced part of 14A of the rod 14, and an end plug 23. The rod 14 has passages 24 by which liquid under pressure can be supplied to opposite ends of the enlarged bore 18 to cause the piston 22, and with it the arbor 13, to be moved in either direction. Further passages lead through the arbor to transverse ducts supplying lubricant between the arbor and the sleeve bore, while the end member 15 and roll neck 17 have a passage 25 for oil discharge.

The roll may be used in a 4-high, a 5-high, or a 6-high mill configuration, for example in place of one of the hollow rolls 16, 30, 40, 45, 46 and 116 of the said application Ser. No. 282,717. As the available axial adjustment of the arbor 13 within the sleeve 12 is limited, it is advantageous to provide for alternative use two rolls having arbors of different axial length. Between them, the two rolls are then able to be accommodated to all widths of strip or other workpiece likely to be encountered in the operation of the mill.

With the use of a hollow, compliant, roll as described, roll bending equipment on the work rolls of the mill may be unnecessary because the compliance of the hollow roll provides shape control. To that end, a shape detector, preferably that known under the name VIDIMON, downstream of the mill may be used in conjunction with a closed loop control scheme to vary automatically the position of the arbor within the sleeve for shape control.

Although the foregoing describes and illustrates an arrangement which is concerned mainly with the axial adjustment of the mandrel within a hollow roll, it is realised that alternative advantages are possible with that construction. For example, the annular passages provided for supplying a lubricant between the arbor and the bore of the sleeve may be used to supply hydraulic fluid under intense pressure and effect controlled expansion of the outer shell and so provide an adjustable crown on the roll surface. In that case such hydraulic pressure may be provided by way of one or more selected annular passages. The axial adjustment of the mandrel would then give an ability to control the position of the hydraulically induced crown on the roll surface.

I claim:

1. A rolling mill comprising at least four rolls, at least one of said rolls having axial compliance and comprising:

a sleeve having a bore therethrough and forming the barrel of said roll;

first and second end members secured on said bore at respective ends of said sleeve, at least one of said end members having therethrough a passage with a diameter significantly less than the diameter of said bore;

an arbor located within said bore between said end members and axially movable within said bore to adjust the axial compliance of said roll;

a roll neck integral with each said member, for mounting said roll in a rolling mill, one said neck having therein a cylinder-forming recess; and adjustment means for said arbor, said means including a piston located in said recess and connection means operatively attached between said arbor and said piston and passing axially through said passage of said one end member.

2. A rolling mill roll having adjustable axial compliance comprising:

a sleeve having a bore therethrough and forming the barrel of said roll;

first and second end members secured on said bore and respective ends of said sleeve, at least one one of said end members having therethrough a passage with a diameter significantly less than the diameter of said bore;

an arbor located within said bore between said end members and axially movable within said bore to adjust the axial compliance of said roll;

a roll neck integral with each said end member, for mounting said roll in a rolling mill, one said neck having therein a cylinder-forming recess;

and adjustment means for said arbor, said means including a piston located in said recess and connection means operatively attached between said arbor and said piston and passing axially through said passage of said one end member.

3. A rolling mill roll as claimed in claim 2, wherein said connection means is an actuating rod secured to said arbor and extending out of said end member to said piston.

4. A rolling mill roll as claimed in claim 2, wherein at least one of said end members has fluid passages therethrough for the supply and discharge of fluid to and from said bore.

* * * * *